US008763869B2

(12) United States Patent
Gerard-Goddet

(10) Patent No.: US 8,763,869 B2
(45) Date of Patent: Jul. 1, 2014

(54) WRIST-WEARABLE DEVICE

(75) Inventor: Matthieu Gabriel Marie Gerard-Goddet, Taipei (TW)

(73) Assignee: Mitac International Corp., Kuei-Shan Hsiang, Tao-Yuan Hsien (TW)

( * ) Notice: Subject to any disclaimer, the term of this patent is extended or adjusted under 35 U.S.C. 154(b) by 355 days.

(21) Appl. No.: 13/404,005

(22) Filed: Feb. 24, 2012

(65) Prior Publication Data

US 2013/0219960 A1 Aug. 29, 2013

(51) Int. Cl.
*A44C 5/14* (2006.01)

(52) U.S. Cl.
USPC ..... 224/176; 224/164

(58) Field of Classification Search
CPC ..... A44C 5/00; A44C 5/14; A44C 5/22; A45C 5/14; A45C 5/0053
USPC ..... 224/164, 152, 168, 169, 170, 219, 166, 224/167, 179, 180, 222, 267; 2/322, 336; 63/3.2
See application file for complete search history.

(56) References Cited

U.S. PATENT DOCUMENTS 30,969 A * 12/1860 Hews ..... 24/521
223,043 A * 12/1879 Hamilton, Jr. ..... 63/11
267,526 A * 11/1882 Herzog ..... 24/163 R
1,216,322 A * 2/1917 Kales ..... 224/164
1,313,843 A * 8/1919 Trommer ..... 224/179
1,626,160 A * 4/1927 Schwalberg ..... 224/178
2,359,148 A * 9/1944 Partridge ..... 224/164
2,420,435 A * 5/1947 Lackow ..... 224/164
2,586,758 A * 2/1952 Zerr ..... 24/518
4,470,174 A * 9/1984 Rhea ..... 24/68 E
4,700,874 A * 10/1987 Mock et al. ..... 224/178
5,831,535 A * 11/1998 Reisman et al. ..... 340/573.4
7,406,789 B2 * 8/2008 Story ..... 40/633
7,946,065 B2 * 5/2011 Ali et al. ..... 40/633
8,408,436 B2 * 4/2013 Berry et al. ..... 224/176

* cited by examiner

*Primary Examiner* — Justin Larson
*Assistant Examiner* — Lester L Vanterpool
(74) *Attorney, Agent, or Firm* — Winston Hsu; Scott Margo

(57) ABSTRACT

A wrist-wearable device uses a loop keeper to securely keep the wristband at place. The loop keeper includes a first protrusion extending from a first inner surface for engaging with one of a plurality of first eyelets of a first wristband and avoiding the first wristband from falling out of the loop keeper to flap around. The loop keeper also includes a second protrusion extending from a second inner surface for engaging with one of a plurality of second eyelets of a second wristband, which the loop keeper is slidably disposed on, so as to provide ease experience for the user from readjust the keeper every time.

17 Claims, 4 Drawing Sheets

WRIST-WEARABLE DEVICE

BACKGROUND OF THE INVENTION

1. Field of the Invention

The present invention relates to a wrist-wearable device, and more particularly, to a wrist-wearable device having secured wristband loop keeper.

2. Description of the Prior Art

For a wrist-wearable device such as a wristwatch or a wrist-type GPS system, which is equipped with a buckle tang system, the wristband is usually inserted in a loop "keeper" to avoid the wristband to flap around. In most cases, the keeper of the prior art is a simple loop freely slidable along the short wristband of the device. User may slide the keeper to a proper position on the short wristband such that the free long wristband may be inserted into the keeper, secured by the keeper from flapping around.

Conventional wrist-wearable devices equipped with such loop keeper in the buckle tang system have several drawbacks. Each time the user wears on the device, after sliding the long wristband into the loop keeper, it's always necessary to readjust the location of the loop keeper to secure the long strap, which means an extra step is always needed. Secondly, the long wristband is highly possible to be unsecured. Once the loop keeper is set up to the right location on the short wristband, the keeper may be at first located at the user's preferred location but very likely to have displacement along the short wristband, causing to unsecure the long wristband. The displacement of the loop keeper may be caused by some of the following reasons: no anchor points to the short wristband, user movements, water or sweat on the wristbands, interaction with the environment, or untight wristband settings by users.

SUMMARY OF THE INVENTION

The invention provides a wrist-wearable device. The wrist-wearable device includes a main body, a first wristband, a second wristband, and loop keeper. The main body includes a first side and a second side opposite to the first side. The first wristband is connected to the first side of the main body and includes a plurality of first eyelets. The second wristband is connected to the second side of the main body and includes a plurality of second eyelets. The loop keeper is slidably disposed on the second wristband for securing the first wristband to the second wristband. The loop keeper has a first inner surface and a second inner surface facing with each other. The look keeper includes a first protrusion and a second protrusion. The first protrusion extends from the first inner surface for engaging with one of the plurality of first eyelets with the first wristband passing through the loop keeper. The second protrusion extends from the second inner surface for engaging with one of the plurality of second eyelets.

The invention also provides a wristband set used for connecting to the sides of a wrist-wearable device. The wristband set includes a first wristband including a plurality of first eyelets, a second wristband including a plurality of second eyelets, and a loop keeper slidably disposed on the second wristband for securing the first wristband to the second wristband. The loop keeper has a first inner surface and a second inner surface facing with each other. The look keeper includes a first protrusion and a second protrusion. The first protrusion extends from the first inner surface for engaging with one of the plurality of first eyelets with the first wristband passing through the loop keeper. The second protrusion extends from the second inner surface for engaging with one of the plurality of second eyelets.

The invention further provides a loop keeper for a first wristband and a second wristband. The first wristband is connected to a first side of a wrist-wearable device and having a plurality of first eyelets. The second wristband is connected to a second side of the wrist-wearable device and having a plurality of second eyelets. The loop keeper is slidably disposed on the second wristband and includes a body, a first protrusion, and a second protrusion. The body has a first inner surface and a second inner surface facing with each other. The first protrusion extends from the first inner surface for engaging with one of the plurality of first eyelets with the first wristband passing through the loop keeper. The second protrusion extends from the second inner surface for engaging with one of the plurality of second eyelets.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
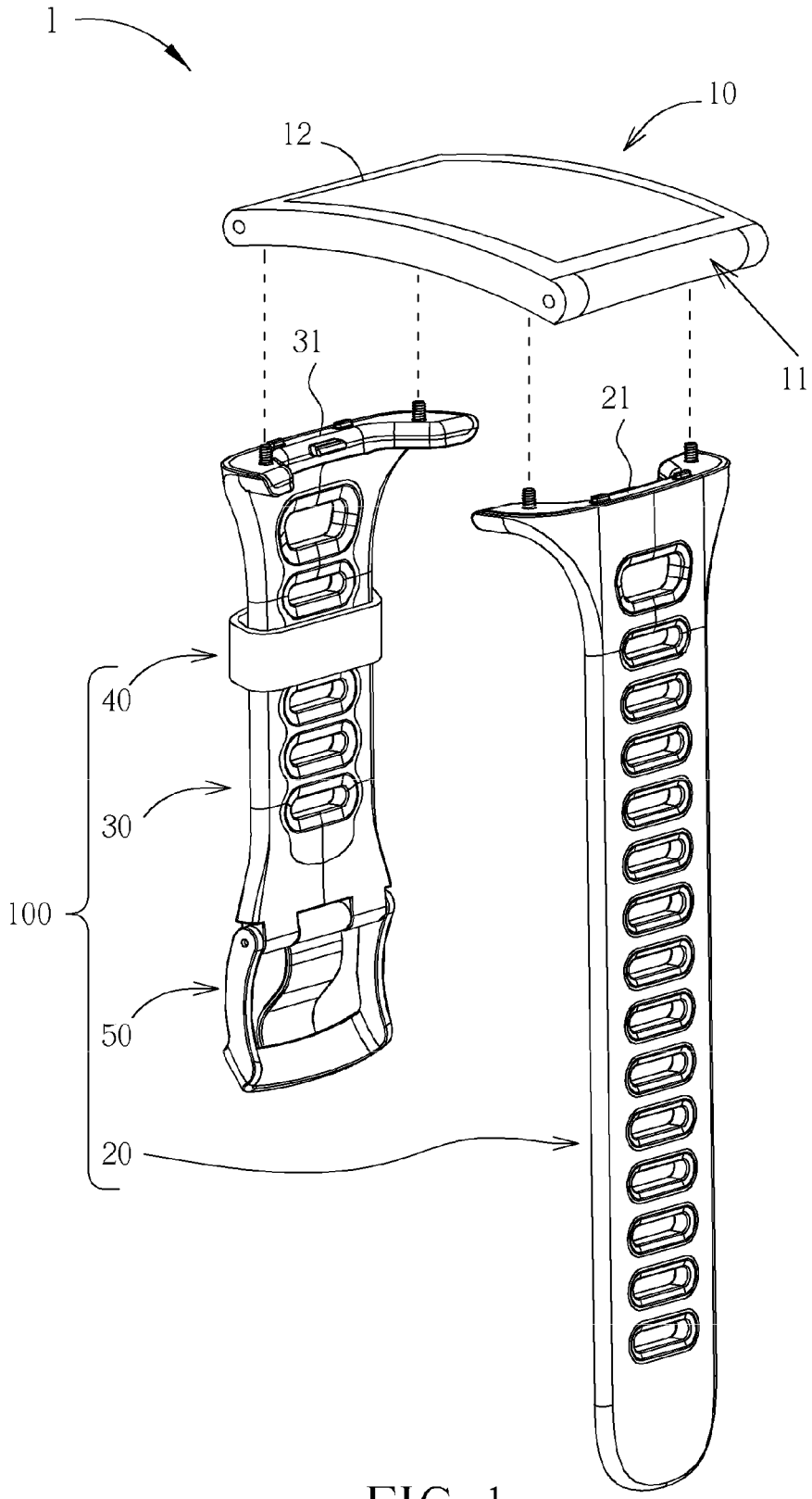
FIG. 1 is an illustration of a wrist-wearable device according to an embodiment of the invention.

Please refer to FIG. 1, which is an illustration of a wrist-wearable device 1 according to an embodiment of the invention. The wrist-wearable device 1 may be a wrist watch (either electronic or mechanical), a global positioning system (GPS), or a portable device like a music player or a cell phone that is designed for light weight and compact size. In the invention, a user may wear the wrist-wearable device 1 on his/her wrist, arm, or the thigh, depending on the device's design. The wrist-wearable device 1 includes a main body 10 and a wristband set 100. The main body 10 may be the watch body, the GPS device, or any aforementioned device. The wristband set 100 includes a first wristband 20, a second wristband 30, and a loop keeper 40. In the common use, the wristband set 100 may also use a buckle tang system 50 to combine the two wristbands 20, 30 if the user wants to wear the wrist-wearable device 1. However, the buckle tang system 50 may also be substituted with some other available type of combining structure. Shown as an exploded view of the wrist-wearable device 1 in FIG. 1, the first wristband 20 is connected to a first side 11 of the main body 10 via a first end 21 of the first wristband 20 and the second wristband 30 is connected to a second side 12 of the main body 10 via a second end 31 as an assembled device. And it is obvious that the first side 11 and the second side 12 of the main body 10 are opposite to each other.

The buckle tang system 50 is disposed at an end, other than the second end 31, of the second wristband 30 where the first wristband 20 may be inserted through and combined. The loop keeper 40 is slidably disposed on the second wristband 30 where the first wristband 20 may be passing through after the wristband 20 is inserted through the buckle tang system 50.

Figure 2:
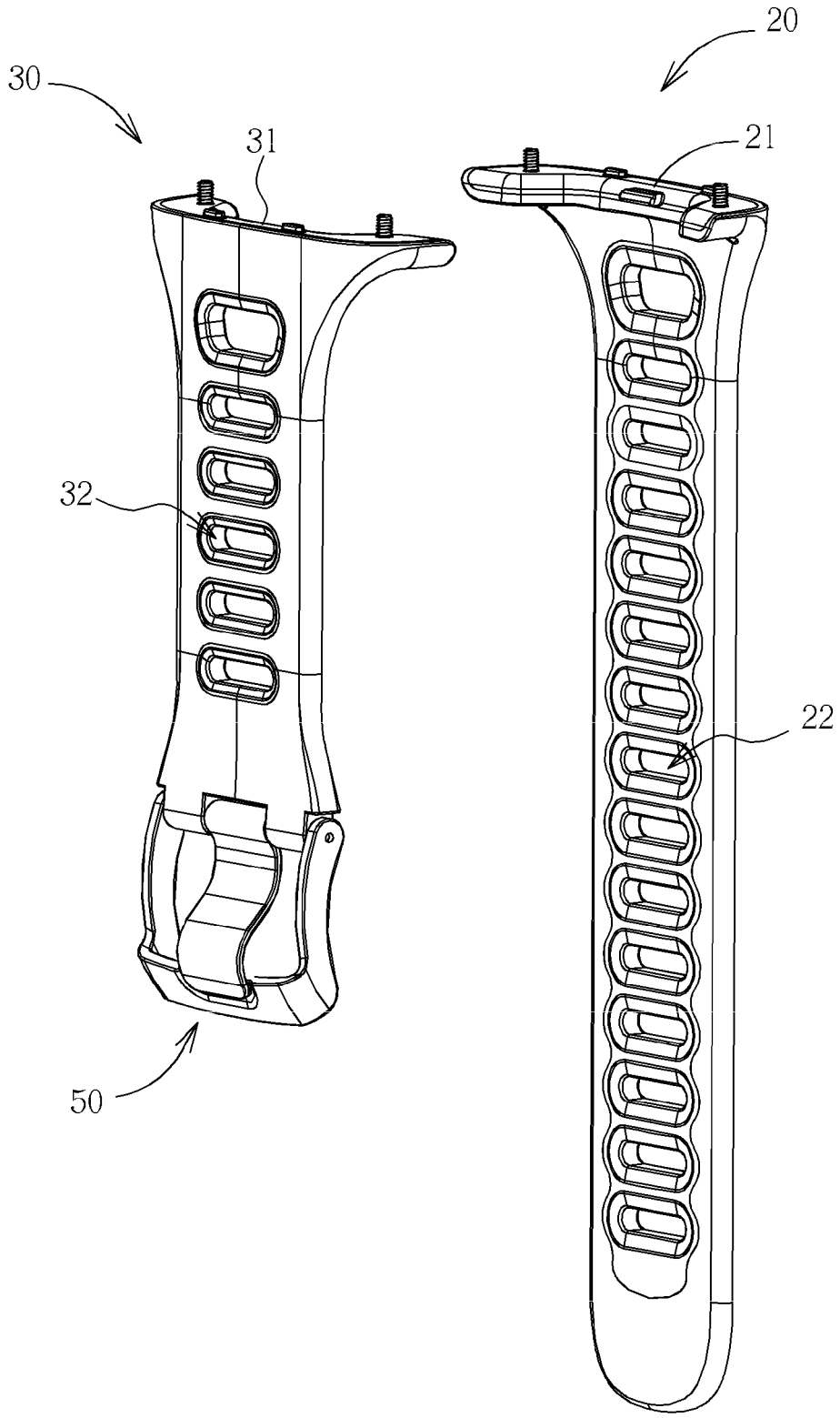
FIG. 2 is an illustration of a first wristband and a second wristband of the wrist-wearable device in FIG. 1.

Please refer to FIG. 2. FIG. 2 is an illustration of the first wristband 20 and the second wristband 30 of the wrist-wearable device 1 in FIG. 1. As can be seen from FIG. 2, the first wristband 20 includes a plurality of first eyelets 22 aligning straight and uniformly distanced from each other. The first eyelets 22 have substantially the same dimension, the width and the length, except for the very first one next to the first end 21, which is larger in dimension than the rest of the first eyelets 22 but can be equally the same as the rest in other embodiment though. The first eyelets 22 are used for providing one being coupled with the buckle tang system 50 as the first wristband 20 is inserted through the buckle tang system 50. The second wristband 30 includes a plurality of second eyelets 32 aligning straight and uniformly distanced from each other, too. The second eyelets 32 have substantially the same dimension, the width and the length, except for the very first one next to the second end 31, which is larger in dimension than the rest of the second eyelets 32 but can be equally the same as the rest in other embodiment though. For the invention, the second eyelets 32 are used for providing one being coupled with the loop keeper 40 as shown in FIG. 1.

Figure 3:
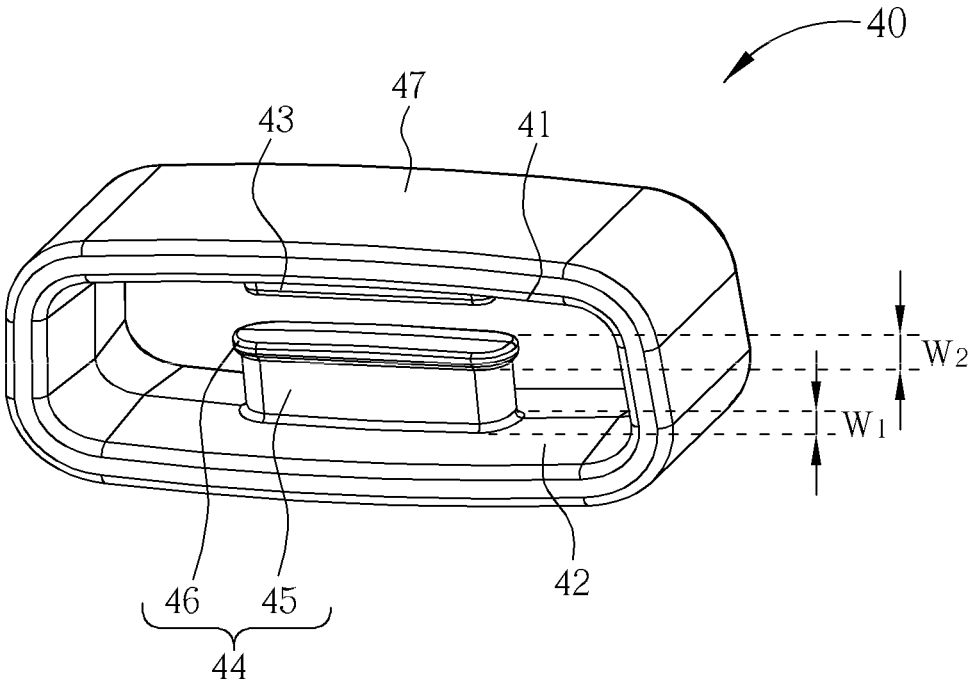
FIG. 3 is an illustration of a loop keeper of the wrist-wearable device in FIG. 1.
Figure 4:
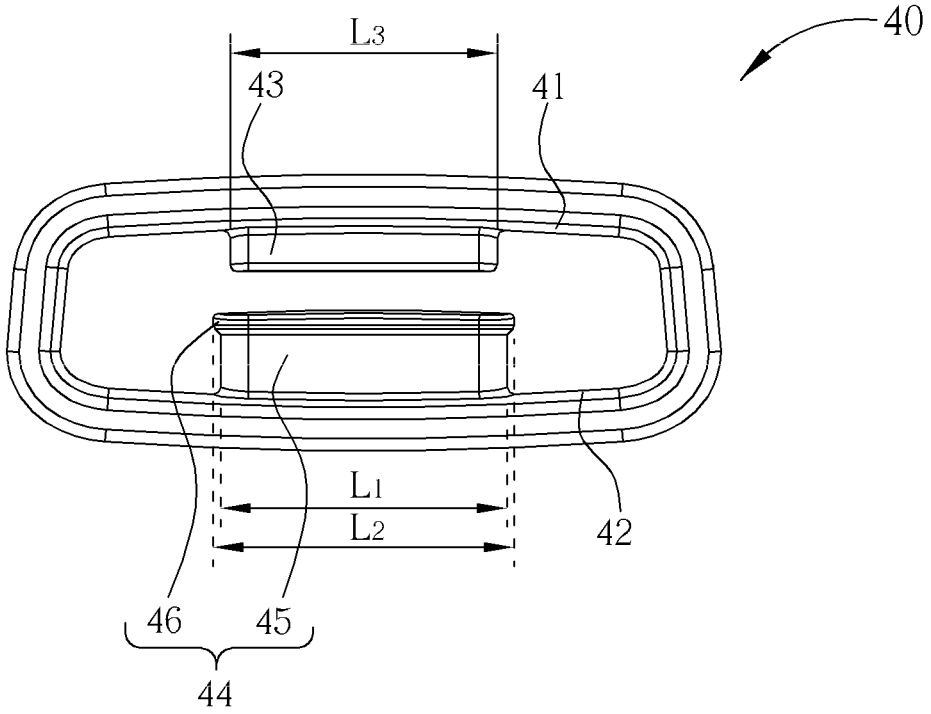
FIG. 4 is an illustration of the front view of the loop keeper in FIG. 3.

Please refer to FIG. 3 and FIG. 4. FIG. 3 is an illustration of the loop keeper 40 of the wrist-wearable device 1 in FIG. 1, and FIG. 4 is an illustration of the front view of the loop keeper 40 in FIG. 3. As previously mentioned, the loop keeper 40 is slidably disposed on the second wristband 30 and is used for securing the first wristband 20 passing through the loop keeper 40 to the second wristband 30. In an embodiment as shown in FIG. 3 and FIG. 4, the loop keeper 40 is a hollow four-side ring, which generally forms a rectangular cross-section, with a certain thickness. The loop keeper 40 may be preferably a rubber loop made from Thermoplastic Polyurethane (TPU) or Thermoplastic Rubber (TPR). The elasticity of such materials allows the loop keeper 40 to deform and have flexibility for easy installation to the second wristband 30 and the first wristband 20. The hollow loop keeper 40 includes a body 47, which has a first inner surface 41 and a second inner surface 42 facing with each other, a first protrusion 43, and a second protrusion 44. The first protrusion 43 extends from the first inner surface 41 of the loop keeper 40 and the second protrusion 44 extends from the second inner surface 42 of the loop keeper 40. As a result, the first protrusion 43 and the second protrusion 44 also face with each other and distance from each other to form a gap therebetween. It is to be understood that the shape or the form factor of the loop keeper 40 is not merely limited to such hollow four-side ring. Instead, any loop keeper that is slidable over the second wristband 30 and has two inner surfaces facing with each other is covered by the present invention.

Since the loop keeper 40 is disposed on the second wristband 30, the loop keeper 40 may be adjusted to slide to a preferred location on the second wristband 30. Once located at the preferred location on the second wristband 30, the second protrusion 44 may be inserted into the second eyelet 32 right aligned with the second protrusion 44. In other words, the second protrusion 44 is used to engage with one of the second eyelets 32. The second protrusion 44 has substantially the same cross-sectional width and length as the second eyelets 32, while in this embodiment the second protrusion 44 also includes a body section 45 and an end section 46. The body section 45 extends from the second inner surface 42 and has length $L_1$ and width $W_1$. The end section 46 extends from the body section 45 and has slightly larger length $L_2$ and width $W_2$ than the body section 45. More specifically, the length $L_1$ and width $W_1$ of the body section 45 of the second protrusion 44 are substantially the same as the second eyelets 32. In this way, the second protrusion 44 may securely lock the loop keeper 40 on the second wristband 30 when the second protrusion 44 engages with one of the second eyelets 22 since the end section 46 of the second protrusion 44 has slightly larger dimension than the body section 45 and the second eyelets 32. It also generates a click sense when the second protrusion 44 engages with one of the second eyelets 32. This gives a feedback to the user indicating that the second protrusion 44 of the loop keeper 40 is firmly locked with the second wristband 30.

On the other hand, to also secure the first wristband 20 from flapping around, the first wristband 20 may pass through the loop keeper 40 and be secured by the loop keeper 40. The first protrusion 43 of the loop keeper 40 is used to insert into the first eyelet 22 right aligned with the first protrusion 43. In other words, the first protrusion 43 is used to engage with one of the first eyelets 22. In this embodiment, the first protrusion 43 has substantially the same cross-sectional width and length as the first eyelets 22 and is smaller in its cross-sectional width and length $L_3$ than the second protrusion 44. In this way, as the first protrusion 43 engages with one of the first eyelets 22, the loop keeper 40 may be used to properly keep the second wristband 30 at place. In other words, the first protrusion 43 keeps the first wristband 20 in position, avoiding the first wristband 20 from flapping around, and the second protrusion 44 securely locks the loop keeper 40 on the second wristband 30, easing the user experience to wear on the wrist-wearable device 1 and avoiding users each time to readjust the loop keeper 40.

Such configuration of the first protrusion 43 and the second protrusion 44 is only an exemplary one of the embodiments of the invention. In other embodiments, it may also be the first protrusion, which is just like the second protrusion 44 in FIG. 3, that has a body second and an end section slightly larger in its cross-sectional width and length than the body section, and the second protrusion is just like the first protrusion 43 in FIG. 3. In such embodiment, the loop keeper eases the user experience to wear on the wrist-wearable device and avoids users each time to readjust the loop keeper 40 (the second protrusion simply position the loop keeper on the second wristband), and the first protrusion securely keeps the first wristband at place (the first protrusion engages and lock the first wristband). In still another embodiment, both protrusions of the loop keeper may also be the same type as the first protrusion 43 in FIG. 3, which has substantially the same dimension as the first eyelets, or as the second protrusion 44 in FIG. 3, which has slightly larger dimension at the end to securely lock the wristbands.

The invention provides some embodiments that disclose a wrist-wearable device using a loop keeper to securely keep the wristband at place. The loop keeper uses the first protrusion extending from the first inner surface for engaging with one of the first eyelets of the first wristband and avoiding the first wristband from falling out of the loop keeper to flap around. The loop keeper also uses the second protrusion extending from the second inner surface for engaging with one of the second eyelets of the second wristband, which the loop keeper is slidably disposed on, so as to provide ease experience for the user from readjust the keeper every time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wrist-wearable device, comprising:

a main body, comprising a first side and a second side opposite to the first side;

a first wristband connected to the first side of the main body, the first wristband comprising a plurality of first eyelets;

a second wristband connected to the second side of the main body, the second wristband comprising a plurality of second eyelets; and a loop keeper slidably disposed on the second wristband for securing the first wristband to the second wristband, the loop keeper having a first inner surface and a second inner surface facing with each other, the look keeper comprising:

a first protrusion extending from the first inner surface for engaging with one of the plurality of first eyelets with the first wristband passing through the loop keeper; and a second protrusion extending from the second inner surface for engaging with one of the plurality of second eyelets.

2. The wrist-wearable device of claim 1, wherein the first protrusion has substantially the same cross-sectional width and length as the first eyelets and the second protrusion has substantially the same cross-sectional width and length as the second eyelets.

3. The wrist-wearable device of claim 1, wherein at least one of the first protrusion and the second protrusion of the loop keeper comprises a body section and an end section, the body section extending from the corresponding inner surface of the loop keeper, the end section extending from the body section and having larger cross-sectional width and length than the body section.

4. The wrist-wearable device of claim 3, wherein the end section of the at least one of the first protrusion and the second protrusion engages with corresponding one of the first eyelets and the second eyelets and locks the corresponding one of the first wristband and the second wristband to the loop keeper.

5. The wrist-wearable device of claim 1, wherein one of the first protrusion and the second protrusion is smaller in its cross-sectional width and length than the other of the first protrusion and the second protrusion.

6. The wrist-wearable device of claim 1, wherein the loop keeper is a rubber loop made from Thermoplastic Polyurethane (TPU) or Thermoplastic Rubber (TPR).

7. The wrist-wearable device of claim 1, wherein the main body is a watch or a global positioning system.

8. A wristband set, used for connecting to the sides of a wrist-wearable device, the wristband set comprising:

a first wristband comprising a plurality of first eyelets;

a second wristband comprising a plurality of second eyelets; and a loop keeper slidably disposed on the second wristband for securing the first wristband to the second wristband, the loop keeper having a first inner surface and a second inner surface facing with each other, the look keeper comprising:

a first protrusion extending from the first inner surface for engaging with one of the plurality of first eyelets with the first wristband passing through the loop keeper; and a second protrusion extending from the second inner surface for engaging with one of the plurality of second eyelets.

9. The wristband set of claim 8, wherein the first protrusion has substantially the same cross-sectional width and length as the first eyelets and the second protrusion has substantially the same cross-sectional width and length as the second eyelets.

10. The wristband set of claim 8, wherein at least one of the first protrusion and the second protrusion of the loop keeper comprises a body section and an end section, the body section extending from the corresponding inner surface of the loop keeper, the end section extending from the body section and having larger cross-sectional width and length than the body section.

11. The wristband set of claim 10, wherein the end section of the at least one of the first protrusion and the second protrusion engages with corresponding one of the first eyelets and the second eyelets and locks the corresponding one of the first wristband and the second wristband to the loop keeper.

12. The wristband set of claim 8, wherein one of the first protrusion and the second protrusion is smaller in its cross-sectional width and length than the other of the first protrusion and the second protrusion.

13. The wristband set of claim 8, wherein the loop keeper is a rubber loop made from Thermoplastic Polyurethane (TPU) or Thermoplastic Rubber (TPR).

14. A loop keeper for a first wristband and a second wristband, the first wristband connected to a first side of a wrist-wearable device and having a plurality of first eyelets, the second wristband connected to a second side of the wrist-wearable device and having a plurality of second eyelets, the loop keeper slidably disposed on the second wristband and comprising:

a body having a first inner surface and a second inner surface facing with each other;

a first protrusion extending from the first inner surface for engaging with one of the plurality of first eyelets with the first wristband passing through the loop keeper; and a second protrusion extending from the second inner surface for engaging with one of the plurality of second eyelets.

15. The loop keeper of claim 14, wherein at least one of the first protrusion and the second protrusion of the loop keeper comprises a body section and an end section, the body section extending from the corresponding inner surface of the loop keeper, the end section extending from the body section and having larger cross-sectional width and length than the body section.

16. The loop keeper of claim 14, wherein one of the first protrusion and the second protrusion is smaller in its cross-sectional width and length than the other of the first protrusion and the second protrusion.

17. The loop keeper of claim 14, wherein the loop keeper is a rubber loop made from Thermoplastic Polyurethane (TPU) or Thermoplastic Rubber (TPR).

* * * * *